US006101683A

United States Patent [19]

Deschenes et al.

[11] Patent Number: 6,101,683

[45] Date of Patent: Aug. 15, 2000

[54] LOOP FASTENER, FASTENER CLIP INCLUDING SAME AND LOOP FASTENER DISPENSING TOOL

[75] Inventors: Charles L. Deschenes, North Attleboro, Mass.; William J. Cooper, Woonsocket, R.I.; Clark L. Grendol, Sturbridge; Clinton N. Matthews, Stoughton, both of Mass.

[73] Assignee: Avery Dennison Corporation, Pasadena, Calif.

[21] Appl. No.: 09/212,100

[22] Filed: Dec. 15, 1998

Related U.S. Application Data

[63] Continuation-in-part of application No. 09/150,324, Sep. 9, 1998, which is a continuation-in-part of application No. 09/054,195, Apr. 2, 1998, which is a continuation-in-part of application No. 09/054,099, Apr. 1, 1998.

[51] Int. Cl.[7] ..... B65D 63/00; B25B 25/00

[52] U.S. Cl. ..... 24/16 PB; 24/17 AP; 24/30.5 P

[58] Field of Search ..... 24/16 BP, 30.5 P, 24/17 AP; 206/338

[56] References Cited

U.S. PATENT DOCUMENTS

| | | | |
|---|---|---|---|
| 3,517,702 | 6/1970 | Mueller et al. | 24/16 PB |
| 3,979,799 | 9/1976 | Merser et al. . | |
| 4,059,300 | 11/1977 | Moberg et al. | 24/16 PB |
| 4,183,567 | 1/1980 | Bone . | |
| 4,240,183 | 12/1980 | Sumimoto et al. | 24/16 PB |
| 4,441,233 | 4/1984 | Swift | 24/16 PB |
| 4,854,014 | 8/1989 | Ueno | 24/16 PB |
| 5,501,002 | 3/1996 | Fukami . | |
| 5,738,265 | 4/1998 | Hirai et al. . | |
| 5,799,375 | 9/1998 | Fukami . | |
| 5,906,039 | 5/1999 | Fukami et al. . | |
| 5,908,110 | 6/1999 | Hirai . | |

*Primary Examiner*—Victor N. Sakran
*Attorney, Agent, or Firm*—Kriegsman & Kriegsman

[57] ABSTRACT

A loop fastener well-suited for attaching tags to articles of commerce. In one embodiment, the loop fastener comprises a flexible filament having a first end and a second end. In addition, the loop fastener comprises a socket, the socket having a top surface, a bottom surface and a side surface, the side surface being generally octagonal in shape and having a front end. The socket is also shaped to include a channel and a circumferential flange, the channel being generally circular in transverse cross-section and extending from the top surface to the bottom surface, the flange extending partially into the channel and being shaped to include an arcuate surface extending convexly downwardly from the top surface. The first end of the flexible filament is joined both to the top surface and the front end of the socket, the flexible filament extending away from the socket generally perpendicularly relative to the channel. The loop fastener further comprises an inserting element disposed at the second end of the flexible filament, the inserting element including a plug insertable into the channel and past the flange, the plug being engageable with the flange after the plug has been inserted therepast so as to keep the plug from being easily withdrawn back past the flange.

23 Claims, 14 Drawing Sheets

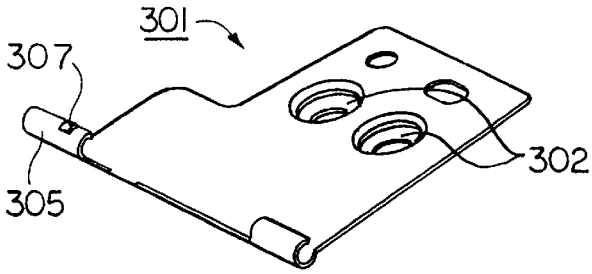
FIG. 27(a)
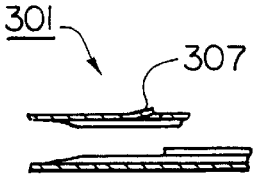
FIG. 27(c)
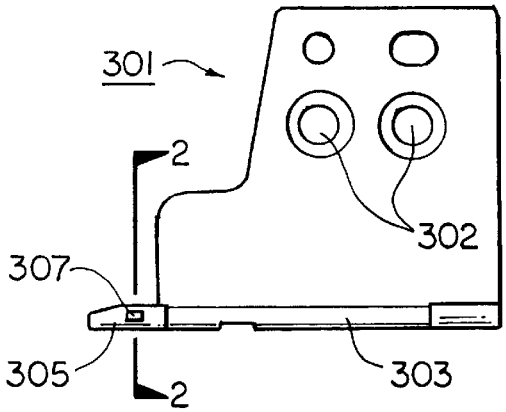
FIG. 27(b)
FIG. 28
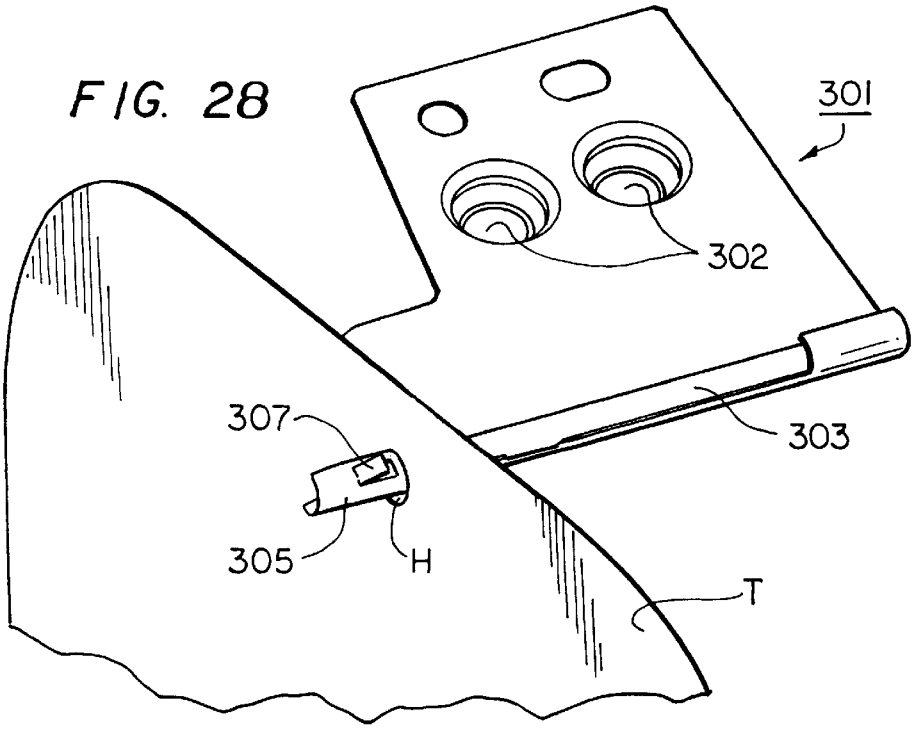

LOOP FASTENER, FASTENER CLIP INCLUDING SAME AND LOOP FASTENER DISPENSING TOOL

CROSS-REFERENCE TO RELATED APPLICATIONS

The present application is a continuation-in-part of presently-pending U.S. patent application Ser. No. 09/150,324 filed Sep. 9, 1998 in the names of Charles L. Deschenes et al, which in turn is a continuation-in-part of presently-pending U.S. patent application Ser. No. 09/054,195, filed Apr. 2, 1998, in the names of Charles L. Deschenes et al., which in turn is a continuation-in-part of presently-pending U.S. patent application Ser. No. 09/054,099, filed Apr. 1, 1998, in the names of Charles L. Deschenes et al., all three patent applications of which are herein incorporated by reference.

BACKGROUND OF THE INVENTION

The present invention relates generally to fasteners of the type that are commonly used to attach tags to articles of commerce and more particularly to loop fasteners of the aforementioned type.

Fasteners of the type commonly used to attach tags to articles of commerce are well-known and widely used. Typically, such fasteners are unitary structures made of molded plastic. One of the earlier types of such fasteners, which is still in widespread use today, includes an elongated, flexible filament having a cross-bar disposed at a first end thereof and either a paddle or a second cross-bar disposed at the second end thereof. In use, the cross-bar disposed at the first end is typically inserted first through a tag and then through the desired article of commerce, with the paddle or second cross-bar not being inserted into the article and being used to retain the tag on the fastener. Typically, a plurality of the aforementioned fasteners are fabricated together, either as part of a fastener clip or as continuously-connected fastener stock. The clip-type arrangement is disclosed, for example, in U.S. Pat. No. 3,103,666, inventor Bone, which issued Sep. 17, 1963, and which is incorporated herein by reference. An example of continuously-connected fastener stock is disclosed in U.S. Pat. No. 4,121,487, inventor Bone, which issued Oct. 24, 1978, and which is incorporated herein by reference.

As can be seen in the aforementioned '666 patent, in a clip-type arrangement, the crossbars at the first ends of the respective fasteners are arranged parallel to one another, with each such cross-bar being connected to a common, perpendicularly-extending, runner bar by a corresponding severable connector. In addition, the paddles or cross-bars located at the second ends of the respective fasteners are also arranged parallel to one another. Such paddles or crossbars at the second ends may or may not be connected to one another by severable connectors.

Although, in theory, an individual fastener from the above-described clip could be attached to a desired article by manually detaching the cross-bar at the first end of the fastener from the runner bar and then manually inserting said cross-bar through the desired article, it should be appreciated that the manual insertion of said cross-bar through most articles is very difficult to achieve in practice. This is in part because, to insert the cross-bar through an article (and/or through a hole in a tag), one must first pivot the cross-bar about the first end of the filament so that the cross-bar is placed in a generally parallel orientation relative to the filament and then, while maintaining said generally parallel orientation, insert the cross-bar through the article. However, due to the relatively small size of the cross-bar and the somewhat limited flexibility of the filament at its juncture with the cross-bar, said pivoting action is difficult to perform manually. The manual insertion of a cross-bar through an article is also made difficult by the fact that the cross-bar does not easily penetrate certain types of materials of which the article may be made. Accordingly, for the foregoing and other reasons, fasteners of the type described above, as well as fasteners of the type that make up continuously-connected fastener stock, have typically been dispensed using appropriate fastener dispensing tools.

Examples of fastener dispensing tools adapted for dispensing fasteners from fastener clips of the type described above are disclosed in the following U.S. patents, all of which are incorporated herein by reference: U.S. Pat. No. 3,103,666, inventor Bone, which issued Sep. 17, 1963; U.S. Pat. No. 4,611,740, inventor Kunreuther, which issued Sep. 16, 1986; U.S. Pat. No. 4,040,555, inventor Jenkins, which issued Aug. 9, 1977; U.S. Pat. No. 4,706,362, inventor Strausburg, which issued Nov. 17, 1987; U.S. Pat. No. 4,125,215, inventor Jenkins, which issued Nov. 14, 1978; U.S. Pat. No. 5,020,713, inventor Kunreuther, which issued Jun. 4, 1991; and U.S. Pat. No. 5,529,233, inventors Davignon et al., which issued Jun. 25, 1996.

Examples of fastener dispensing tools adapted for dispensing fasteners from continuously-connected fastener stock are disclosed in the following U.S. patents, all of which are incorporated herein by reference: U.S. Pat. No. 4,121,487, inventor Bone, which issued Oct. 24, 1978; U.S. Pat. No. 5,320,269, inventors Deschenes et al., which issued Jun. 14, 1994; U.S. Pat. No. 4,955,475, inventors McCarthy et al., which issued Sep. 11, 1990; U.S. Pat. No. 4,456,161, inventor Russell, which issued Jun. 26, 1984; U.S. Pat. No. 5,024,365, inventor Bourque, which issued Jun. 18, 1991; and U.S. Pat. No. 4,998,661, inventors Deschenes et al., which issued Mar. 12, 1991.

Whereas filamentary fasteners of the type described above having a cross-bar at a first end thereof and a paddle or a cross-bar at a second thereof are quite useful in attaching tags to many articles of commerce, such fasteners have limited tag-attaching utility for certain articles of commerce, such as sunglasses, which are not made of a material through which the cross-bar may be inserted and then retained thereagainst. For the foregoing reasons, as well as for other applications, various loop fasteners have been devised.

One type of loop fastener comprises a flexible filament having a longitudinally-extending plug at a first end thereof and a transversely-oriented socket at a second end thereof. (A related type of loop fastener includes a cross-bar instead of the aforementioned plug.) Typically, the socket is tubular in shape with opposing open ends and is provided with an apertured wall (or one or more flanges defining an opening of reduced size compared to the remainder of the socket interior) that divides the socket transversely into a pair of symmetric portions. Typically, the plug is in the form of a cone-shaped head and/or includes one or more spring tabs to enable the plug to be inserted through the apertured wall (or past the one or more flanges) from either end of the socket while, at the same time, keeping the plug from being easily withdrawn through the apertured wall after having been inserted therethrough. The spring tabs are typically arranged in a plane perpendicular to the longitudinal axis of the socket. The aforementioned type of loop fastener often further includes a stop, the stop being sized so as not to be insertable through the apertured wall and being positioned at such a distance from the plug so as to prevent the plug, once inserted through the apertured wall of the socket, from being pulled through the opposite open end of the socket to a point where it is accessible for tampering. Accordingly, once the plug has been inserted through the apertured wall (or past the one or more flanges), the fastener locks itself into a loop of a substantially fixed size. For this reason, such loop fasteners are often referred to in the art as "self-lockable loop fasteners."

Self-lockable loop fasteners are to be contrasted with other types of loop fasteners, such as cinching loop fasteners or cable ties (see U.S. Pat. No. 5,333,822, inventors Benoit et al., which issued Aug. 2, 1994 and which is incorporated herein by reference) and shoe-lasting loop fasteners (see U.S. Pat. No. 5,438,724, inventor Merser, which issued Aug. 8, 1995; U.S. Pat. No. 5,586,353, inventor Merser, which issued Dec. 24, 1996; and PCT Appln. No. PCT/US96/19479, filed Jun. 12, 1997, all of which are incorporated herein by reference).

Examples of self-lockable loop fasteners include the Secur-a-tach® family of fasteners commercially available from Avery Dennison Corporation, Framingham, Mass. Self-lockable loop fasteners are also described in the following U.S. patents and patent applications, all of which are incorporated herein by reference: U.S. Pat. No. 3,979,799, inventors Merser et al., which issued Sep. 14, 1976; U.S. Pat. No. 4,559,676, inventor Paradis, which issued Dec. 24, 1985; U.S. Pat. No. 4,183,567, inventor Bone, which issued Jan. 15, 1980; U.S. Design Pat. No. 266,484, inventor Bone, which issued Oct. 12, 1982; U.S. Design Pat. No. 262,436, inventor Bone, which issued Dec. 29, 1981; U.S. Pat. No. 4,245,374, inventor Suzuki, which issued Jan. 20, 1981; U.S. Pat. No. 4,240,183, inventors Sumimoto et al., which issued Dec. 23, 1980; commonly-assigned, presently pending U.S. patent application Ser. No. 08/829,992, inventors Merser et al., filed Apr. 2, 1997; and commonly-assigned, presently pending U.S. patent application Ser. No. 08/938,120, inventor Grendol, filed Sep. 26, 1997.

Self-lockable loop fasteners are typically mass-produced in assemblies of molded plastic, with each fastener of the assembly typically being attached by a severable connector to a common runner bar. Traditionally, to remove an individual self-lockable loop fastener from its assembly, the fastener is manually pulled away from the runner bar until the severable connector connecting the fastener to the runner bar breaks. Once separated from the remainder of the assembly, the plug end of the fastener is then manually inserted into its corresponding socket in the manner specified above.

Although the manual insertion of a plug into its corresponding socket is less difficult than the above-described manual insertion of a cross-bar through an article of commerce, it can readily be appreciated that such an activity, repeatedly performed for successive fasteners over extended periods of time, can be time-consuming, as well as physically and mentally taxing.

Accordingly, efforts have recently been expended in the development of tools that can be used both to detach individual self-lockable loop fasteners from fastener assemblies containing same and to insert the plug end of a fastener into its corresponding socket end. At the same time, efforts have also been expended in the development of improved self-lockable loop fasteners for use with such tools. Examples of the results of such efforts are disclosed in the following documents, all of which are incorporated herein by reference: U.S. Pat. No. 5,501,002, inventor Fukami, which issued Mar. 26, 1996; U.S. Pat. No. 4,483,066, inventor Akira, which issued Nov. 20, 1984; U.S. Pat. No. 4,536,933, inventor Furutsu, which issued Aug. 27, 1985; U.S. patent application Ser. No. 08/649,373, inventors Hirai et al., filed May 17, 1996; PCT Application No. PCT/US97/17687, inventor Hirai, filed Sep. 30, 1997; and PCT Application No. PCT/US97/17688, inventors Fukami et al., filed Sep. 30, 1997.

Commercial embodiments of the fastener assembly (also referred to herein as a "fastener clip") and of the fastener attaching tool of PCT Application Nos. PCT/US97/17687 and PCT/US97/17688, respectively, have been marketed by J. E. Kabushiki Kaisha (Tokyo, Japan) under the trademarks PYLON loop pin and PYLON loop connector, respectively. Although the aforementioned fastener clip and fastener attaching tool have worked generally satisfactorily, the present inventors have observed certain shortcomings therewith. One such shortcoming is the frequent jamming of fasteners in the tool during the dispensing thereof. Another such shortcoming is the difficulty in retaining a tag on the needle of the tool as a fastener is dispensed by the tool through the tag.

SUMMARY OF THE INVENTION

It is an object of the present invention to provide a novel loop fastener.

According to one feature, the loop fastener of the present invention includes, among other things, (i) a flexible filament having a first end and a second end, (ii) a socket, said socket having a top surface, a bottom surface, and a front end, said first end of said flexible filament being joined both to said top surface and to said front end, said socket being provided with a channel and a flange, said channel extending from said top surface to said bottom surface, said flange extending partially into said channel, said flexible filament extending away from said socket generally perpendicularly relative to said channel, and (iii) an inserting element disposed at said second end of said flexible filament, said inserting element including a plug insertable into said channel and engageable with said flange so as to keep said plug from being easily withdrawn from said channel back past said flange.

According to another feature, the loop fastener of the present invention includes, among other things, (i) a flexible filament having a first end and a second end, (ii) a socket, said socket being disposed at said first end of said flexible filament, said socket having a top surface, a bottom surface, a channel, said channel extending from said top surface to said bottom surface and being generally circular in transverse cross-section, and a circumferential flange, said circumferential flange extending partially into said channel and being shaped to include an arcuate surface extending convexly downwardly from said top surface and (iii) an inserting element disposed at said second end of said flexible filament, said inserting element including a plug insertable into said transverse channel and engageable with said flange so as to keep said plug from being easily withdrawn from said channel back past said flange.

According to yet another feature, the loop fastener of the present invention includes, among other things, (i) a flexible filament having a first end and a second end, and (ii) a socket, said socket being disposed at said first end of said flexible filament, said socket being generally octagonal in cross-sectional shape.

It is another object of the present invention to provide a fastener clip comprising (*a*) one or more loop fasteners of any of the types described above, (*b*) a first runner bar, said first runner bar being severably connected to each socket of the one or more loop fasteners, and (*c*) a second runner bar, said second runner bar being severably connected to each inserting element of the one or more loop fasteners.

Preferably, with respect to the fastener clip described above, at least one of said first runner bar and said second runner bar is not disposed in the same plane as said one or more loop fasteners. More preferably, both of said first runner bar and said second runner bar are not disposed in the same plane as said one or more loop fasteners. Even more preferably, said first and second runner bars are not disposed in the same plane as said one or more loop fasteners, and said first runner bar is spaced forwardly relative to the rear end of each socket and said second runner bar is spaced rearwardly relative to the front end of each inserting element. Still even more preferably, said fastener clips comprise a plurality of like fasteners, said fasteners being arranged parallel to one another and not being disposed in the same plane as said runner bars, with said runner bars being spaced inwardly relative to the front and rear ends of the fasteners.

It is yet another object of the present invention to provide a novel fastener attaching tool.

According to one feature, the fastener attaching tool of the present invention includes a hollow, slotted needle insertable through the hole of a tag, said hollow, slotted needle being shaped to include a detent on its exterior, said detent being adapted to engage said tag so that said tag can be retained securely on said needle while a fastener is inserted through the hole of said tag.

According to another feature, the fastener attaching tool of the present invention includes an arm assembly, said arm assembly being shaped to define a feed channel through which the socket portion of a fastener is adapted to travel, said channel being shaped complementary to said socket to maximize rotational alignment of said socket with an incoming plug.

According to yet another feature, the fastener attaching tool of the present invention includes an arm assembly, said arm assembly being provided with a stop that is shaped to engage the rear end of the socket portion of a fastener so as to maximize translational alignment of said socket with an incoming plug.

Additional objects, features, aspects and advantages of the present invention will be set forth, in part, in the description which follows and, in part, will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate preferred embodiments of the invention and, together with the description, serve to explain the principles of the invention. In the drawings wherein like reference numerals represent like parts:

FIGS. 27(*a*) and 27(*b*) are top, rear, right perspective and top views, respectively, of the needle plate shown in FIG. 8;

FIG. 27(*c*) is a fragmentary section view of the needle plate taken along line 2—2 of FIG. 27(*b*); and FIG. 28 is a perspective view showing how the detent of the needle of FIG. 27(*a*) is used to retain a tag on the needle during insertion of a fastener through the tag.

DETAILED DESCRIPTION OF PREFERRED EMBODIMENTS

Figures 1, 2:
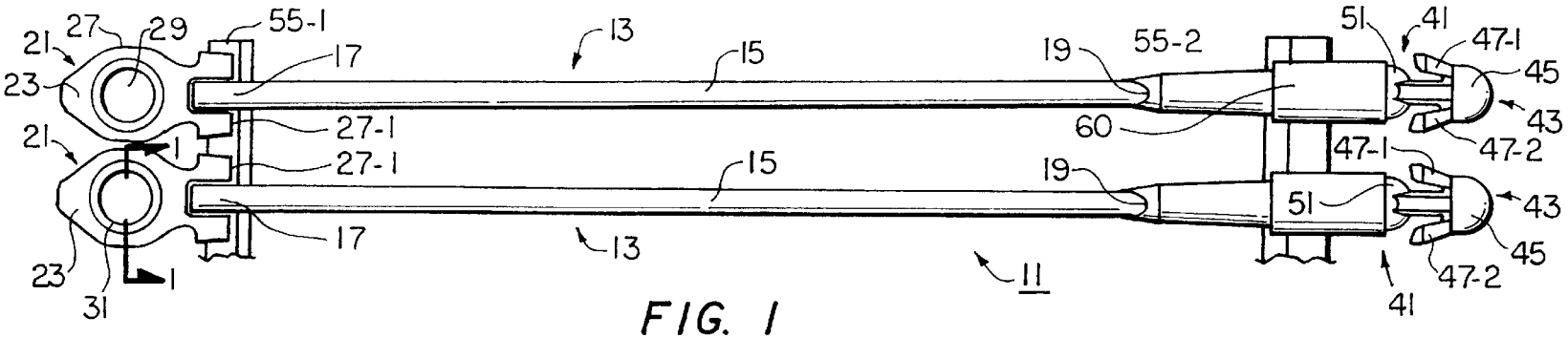
FIG. 1 is a fragmentary, top view of a first embodiment of a fastener clip constructed according to the teachings of the present invention.
FIG. 2 is a fragmentary, front, top, left perspective view of the fastener clip of FIG. 1.
Figure 3:
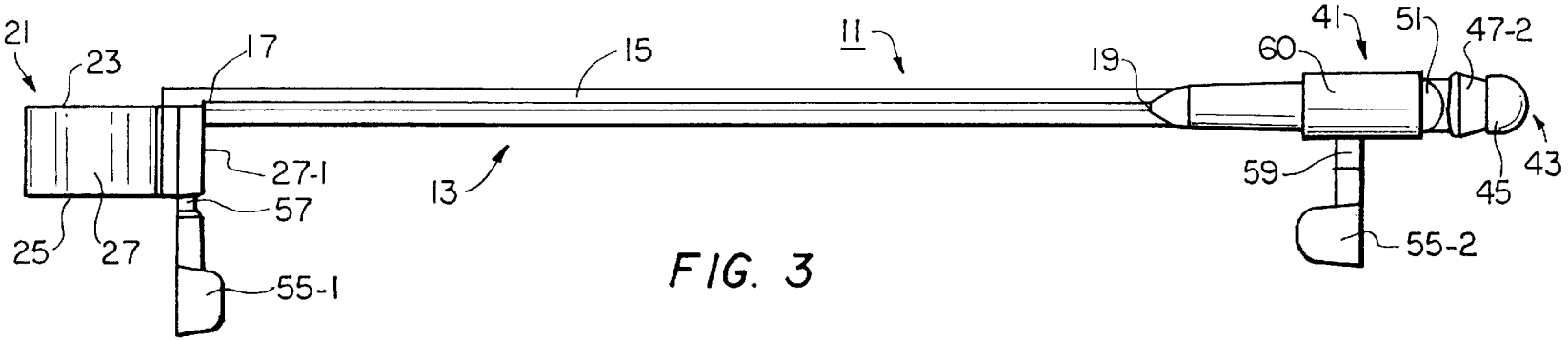
FIG. 3 is a left side view of the fastener clip of FIG. 1.
Figure 4:
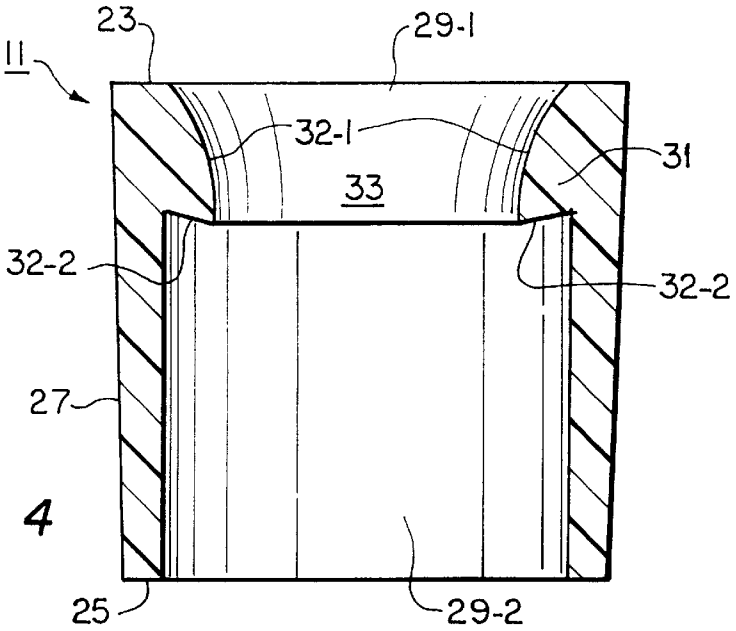
FIG. 4 is an enlarged section view taken along line 1—1 of FIG. 1.
Figure 5:
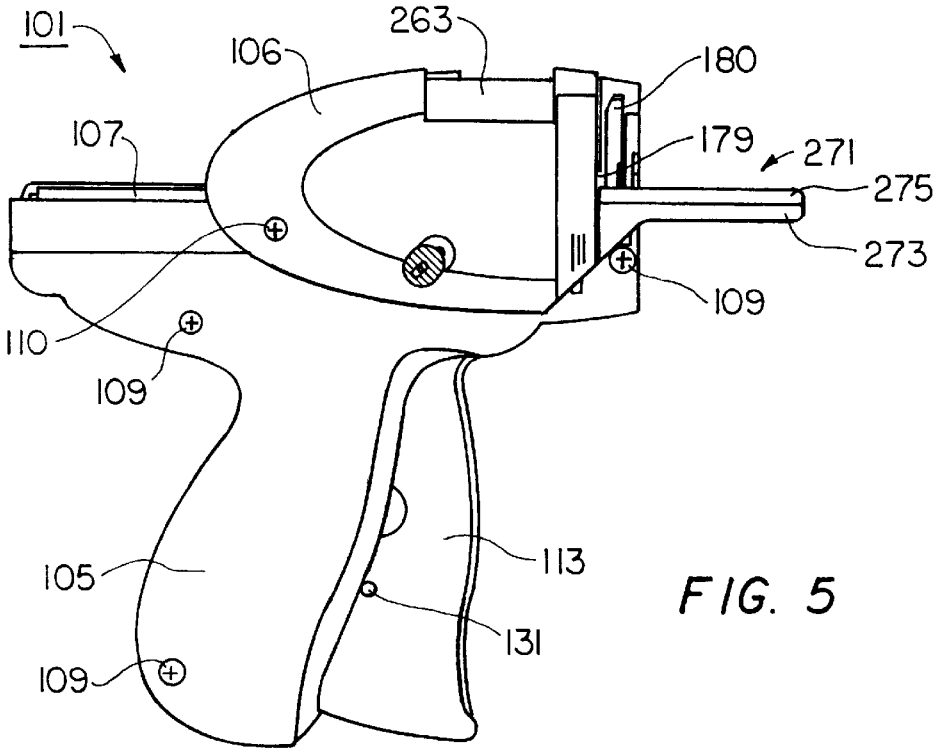
FIG. 5 is a left side view of a first embodiment of a loop fastener dispensing tool constructed according to the teachings of the present invention, said loop fastener dispensing tool being designed for use with the fastener clip of FIG. 1.
Figure 6:
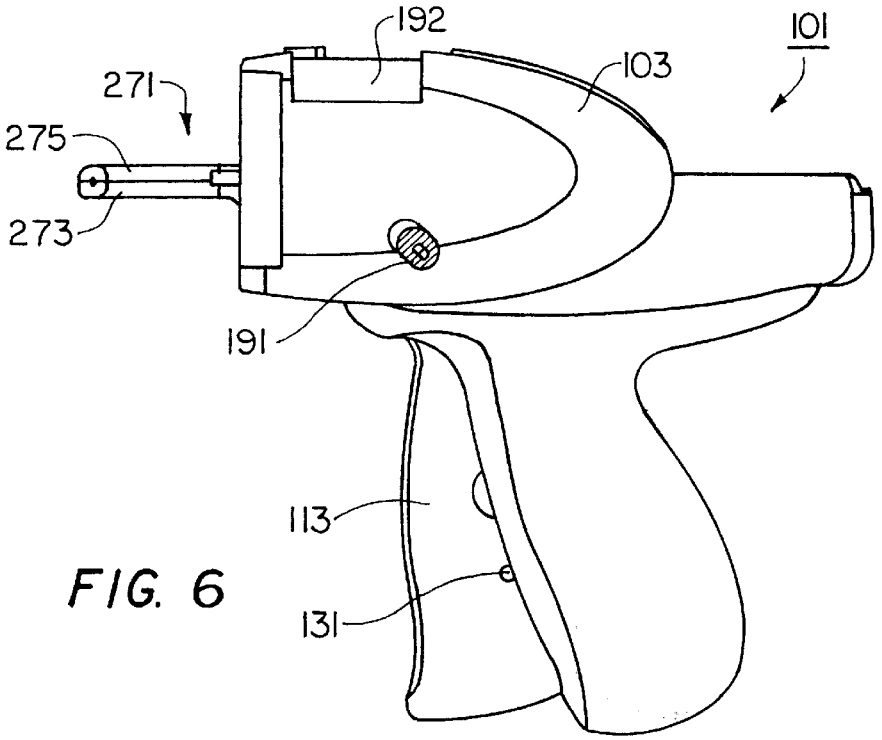
FIG. 6 is a right side view of the loop fastener dispensing tool of FIG. 5.

Referring now to FIGS. 1 through 4, there are shown various views of a first embodiment of a fastener clip constructed according to the teachings of the present invention, the fastener clip being represented generally by reference numeral 11.

Clip 11, which is preferably a unitary structure made of molded plastic, is shaped to include a plurality of identical fasteners 13. Although only one or two fasteners 13 of clip 11 are shown in FIGS. 1 and 2, it is to be understood that clip 11 preferably includes several (e.g., a few dozen or more) such fasteners.

Each fastener 13 is shaped to include a flexible filament 15, flexible filament 15 having a first end 17 and a second end 19.

Fastener 13 also includes a socket 21. Socket 21 has a top surface 23, a bottom surface 25 and a generally octagonally-shaped side surface 27. First end 17 of flexible filament 15 is attached both to top surface 23 and to the top, center of the front end 27-1 of side surface 27.

Socket 21 is additionally provided with a channel 29, channel 29 extending from top surface 23 to bottom surface 25 and extending generally perpendicularly to the longitudinal axis of filament 15. Channel 29 is generally circular in transverse cross-section and broadens slightly in diameter from top surface 23 to bottom surface 25. As seen best in FIG. 4, circumferential flange 31 extends partially into channel 29, flange 31 being shaped to include an arcuate or semiconvex surface 32-1, which extends downwardly a short distance from top surface 23, and a slightly upwardly angled surface 32-2, which extends outwardly a short distance from the bottom of surface 32-1. Flange 31 divides channel 29 into a downwardly-narrowing upper portion 29-1 and a downwardly-broadening lower portion 29-2, upper portion 29-1 and lower portion 29-2 communicating with one another by an aperture 33 defined by flange 31.

Referring back now to FIGS. 1 through 3, fastener 13 further includes an inserting element 41. Inserting element 41 is attached to second end 19 of flexible filament 15, the respective longitudinal axes of inserting element 41 and flexible filament 15 being coaxial. Inserting element 41 is shaped to include a plug 43 at its front end. Plug 43 comprises a head 45 and a pair of outwardly biasing spring tabs 47-1 and 47-2, each of spring tabs 47-1 and 47-2 being attached at one end thereof to head 45. Plug 43 is appropriately dimensioned so that it can readily be inserted downwardly through upper portion 29-1 of channel 29 and past flange 31 (as tabs 47-1 and 47-2 are pivoted inwardly due to their engagement with flange 31), but cannot easily be withdrawn back past flange 31 due to the abutment of the free ends of tabs 47-1 and 47-2 with the underside of flange 31 (once tabs 47-1 and 47-2 have cleared flange 31 and have pivoted back to their initial positions).

As can readily be appreciated, because of the "tapered" shape of semiconvex surface 321, the task of aligning plug 43 with channel 29 for insertion of plug 43 thereinto is facilitated. Moreover, the angle at which surface 32-2 is oriented is such that, once tabs 47-1 and 47-2 are completely inserted past flange 31 and are restored to their relaxed state, surface 32-2 is adapted to matingly receive tabs 47-1 and 47-2, thereby reducing the likelihood that tabs 47-1 and 47-2 can be pivoted inwardly for withdrawal from channel 29.

Inserting element 41 further comprises a stop 51, stop 51 being appropriately sized so as not to fit through aperture 33 of flange 31. Stop 51 is appropriately spaced from plug 43 so as to prevent tampering with spring tabs 47-1 and 47-2 once plug 43 has been completely inserted past flange 31. As can readily be appreciated, because stop 51 delimits forward insertion of plug 43 through channel 29 and because the combination of tabs 47-1 and 47-2 and flange 31 prevent withdrawal of plug 43 from channel 29, fastener 13 is a self-locking loop fastener.

Clip 11 further includes a pair of runner bars 55-1 and 55-2. Runner bars 55-1 and 55-2 are generally parallel to one another and are generally perpendicular to the respective filaments 15 of fasteners 13. Runner bar 55-1, which lies below the plane of fasteners 13, is connected to the respective sockets 21 of fasteners 13 by a corresponding plurality of severable connectors 57. Runner bar 55-1 is spaced forwardly relative to the rear ends of the respective sockets 21, with each connector 57 being attached to its corresponding socket 21 proximate to the front end 27-1 of side surface 27. Runner bar 55-2, which also lies below the plane of fasteners 13, is connected to the respective inserting elements 41 of fasteners 13 by a corresponding plurality of severable connectors 59. Runner bar 55-2 is spaced rearwardly relative to the front ends of the respective inserting elements 41, with each connector 59 being attached to its corresponding inserting element 41 at an enlarged portion 60 located rearwardly relative to its corresponding stop 51.

In use, one may manually separate an individual fastener 13 from its associated clip 11 by pulling a fastener 13 away from runner bars 55-1 and 55-2 until the severable connectors 57 and 59 connecting the fastener 13 to runner bars 55-1 and 55-2, respectively, break. One may then use the thus-separated fastener 13 to form a self-lockable loop (which may be used for the same types of applications as conventional self-lockable loop fasteners) by inserting plug 43 down through upper portion 29-1 of socket 21 and completely past flange 31. With plug 43 thus inserted completely past flange 31, tabs 47-1 and 47-2 prevent easy withdrawal of plug 43 back past flange 31, and stop 51 delimits continued movement of plug 43 through lower portion 29-2 of socket 21.

Although fasteners 13 may be manually dispensed from clip 11 and manually used in the manner described above, it can readily be appreciated that the manual performance of these steps can be, if repeated over time, mentally and/or physically taxing.

Referring now to FIGS. 5 through 10, there are shown various views of one embodiment of a loop fastener dispensing tool designed for use with fastener clip 11, said loop fastener dispensing tool being constructed according to the teachings of the present invention and being represented by reference numeral 101.

Tool 101 comprises a hollow, gun-shaped housing, said housing including a right piece 103, a lower left piece 105, an upper left piece 106 and a cover 107. Cover 107 includes a base portion 107-1 and a pair of sides 107-2 and 107-3. A pair of support ribs 107-4 and 1-7-5 are formed on cover 107 to prevent sides 107-2 and 107-3 from bowing upwardly. Right piece 103, lower left piece 105, upper left piece 106 and cover 107 may be made of any suitable material, such as molded plastic. Right piece 103 and lower left piece 105 are joined together with screws 109. Lower left piece 105 and upper left piece 106 are joined together with screws 110. Cover 107 and lower left piece 105 are joined together with screws 111.

Figure 9:
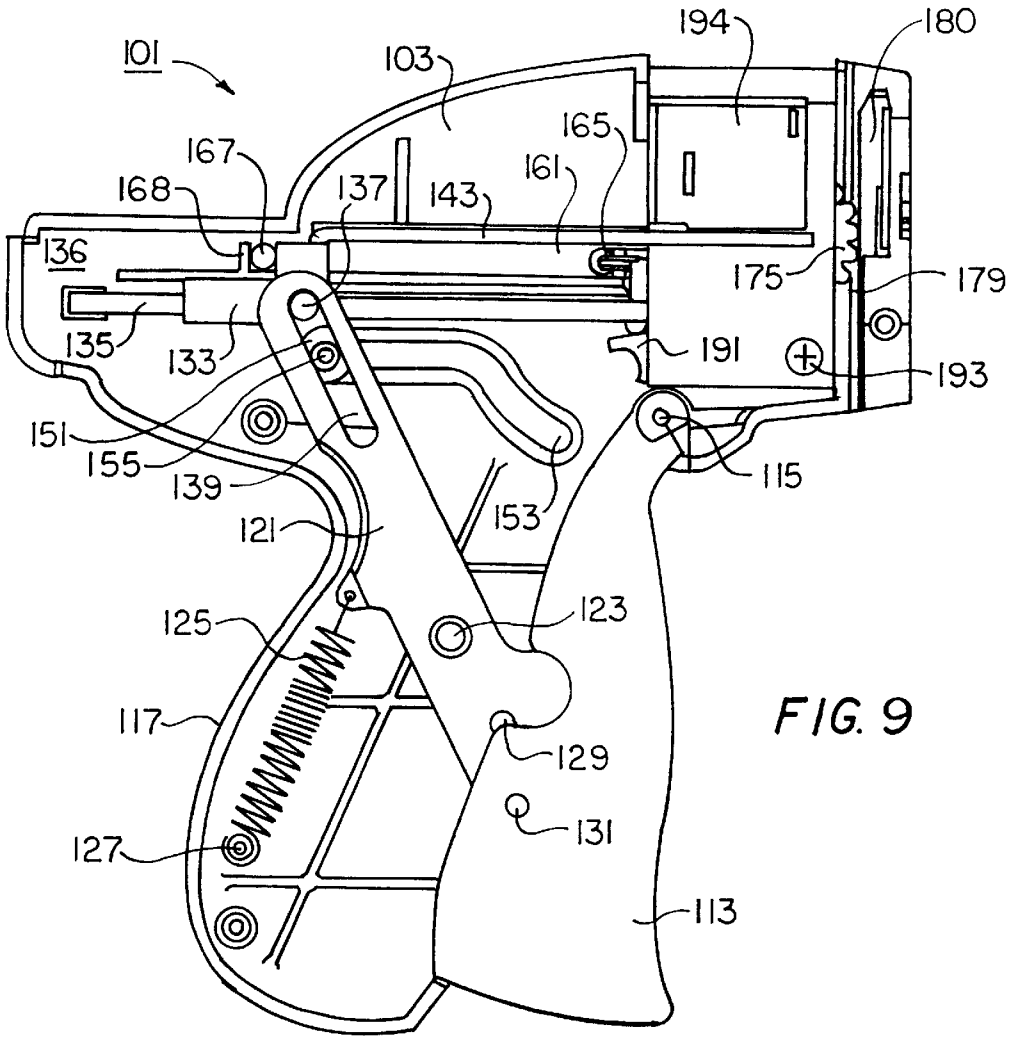
FIG. 9 is a left side view, broken away in part, of the loop fastener dispensing tool of FIG. 5, with the housing cover and left portion of the tool not being shown for clarity.
Figure 7:
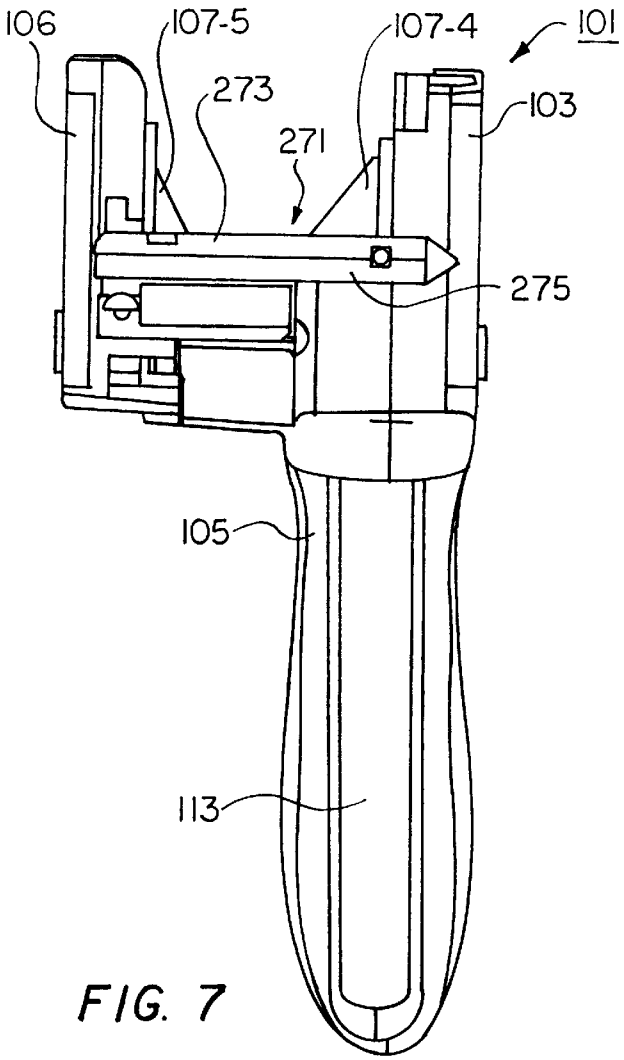
FIG. 7 is a front view of the loop fastener dispensing tool of FIG. 5.
Figure 8:
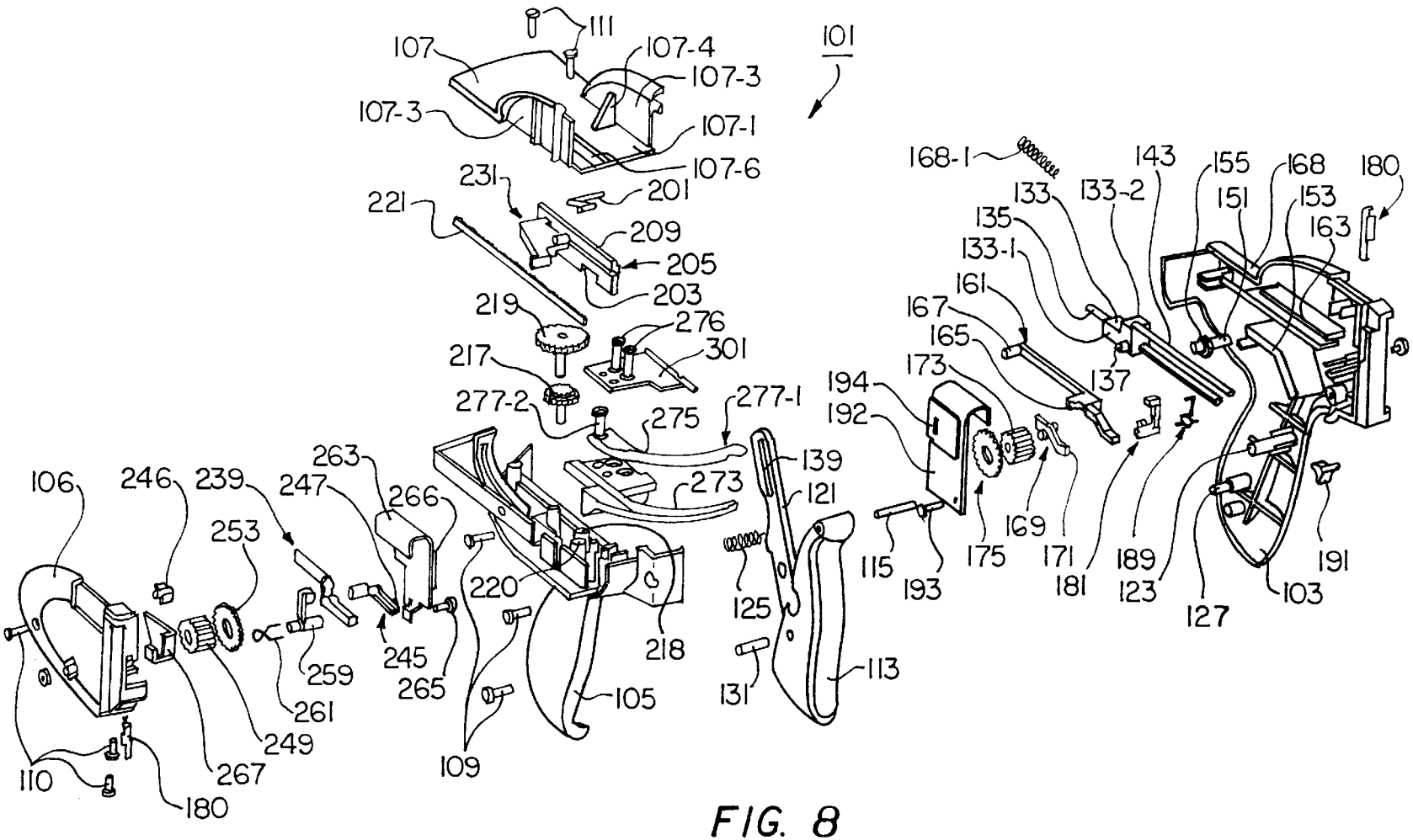
FIG. 8 is a partially exploded, top, front, left, perspective view of the loop fastener dispensing tool of FIG. 5.

Tool 101 also comprises a trigger 113, trigger 113 being pivotally mounted in said housing and extending partially therethrough for digital actuation. Trigger 113 may be made of molded plastic or another similarly suitable material. Referring to FIGS. 8 and 9, trigger 113 is pivotally mounted on a pin 115, pin 115 being mounted on right piece 103 and being appropriately positioned relative thereto so as to enable trigger 113 to be pivoted alternately towards and away from a grip region 117 of right piece 103.

Figure 11:
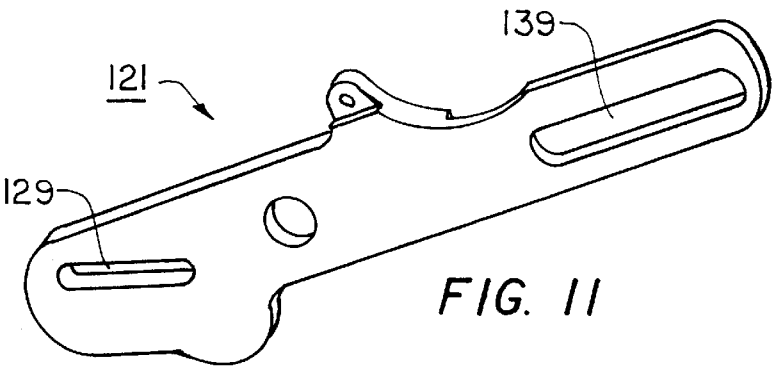
FIG. 11 is an enlarged perspective view of the link shown in FIG. 9.

Tool 101 further comprises a link 121 (also shown separately in FIG. 11), link 121 being mounted on a post 123 formed in right piece 103. Link 121, which may be made of molded plastic, is tension biased by a coiled spring 125, one end of which is secured to link 121 near its midpoint and the other end of which is secured to a post 127 formed on right piece 103. A slot 129 is formed in a lower end of link 121, and a pin 131 mounted on trigger 113 is adapted to slide back and forth across slot 129. In this manner, link 121 and trigger 113 are mechanically coupled to one another, and trigger 113 is normally biased forwardly under the effect of coiled spring 125.

Figure 12:
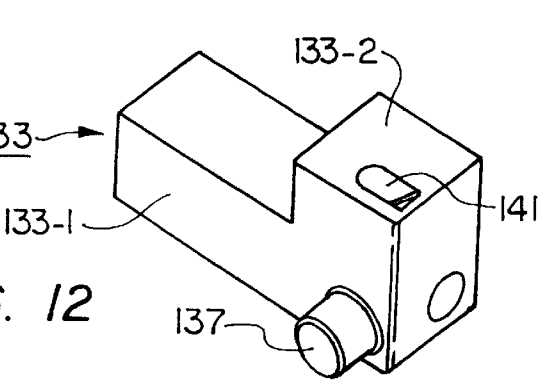
FIG. 12 is an enlarged perspective view of the piston carrier shown in FIG. 9.
Figure 13A:
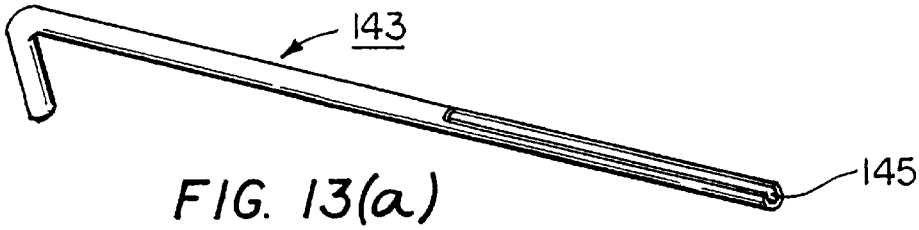
FIGS. 13(*a*) through 13(*c*) are enlarged perspective, section and left side views, respectively, of the piston shown in FIG. 9.
Figure 13B:
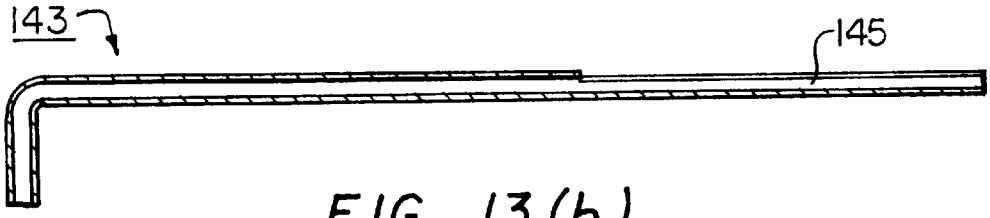
Figure 13C:
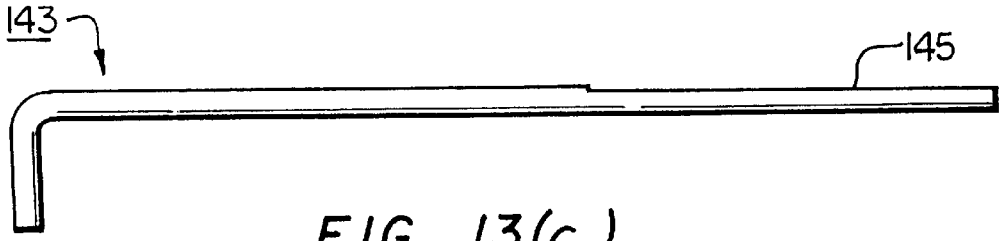

Tool 101 further comprises a piston carrier 133 (also shown separately in FIG. 12). Piston carrier 133, which may be made of molded plastic, is slidably mounted on a cylindrical post 135, post 135 being fixedly mounted at its ends onto and extending longitudinally across a barrel region 136 of right piece 103. Piston carrier 133 includes a base portion 133-1 and a top portion 133-2. Base portion 133-1 is shaped to include a pin 137, which projects from a side wall surface and which engages a slot 139 formed on the upper end of link 121. In this manner, link 121 and piston carrier 133 are mechanically coupled to one another. Piston carrier 133 is also shaped to include a receiving bore 141 formed on an upper surface thereof at a forward location. An L-shaped piston 143 (also shown separately in FIGS. 13(*a*) through 13(*c*)) has a rear leg mounted in bore 141. Piston 143, which may be made of metal, is tubular and is provided with a slit 145 that extends rearwardly for a distance from the front end thereof. As will hereinafter be described, when tool 101 is used to dispense fasteners 13 from a clip 11, the filament 15 of a fastener 13 passes through slit 145, with the rearwardmost end of slit 145 used to engage and to push forwardly on enlarged portion 60 of inserting element 41.

Tool 101 further comprises a cam 151, which may be made of molded plastic. Cam 151, which travels along a cam groove 153, is shaped to include a tubular post 155. Post 155 engages slot 139 of link 121 at a point below pin 137 and receives a linking pin to be described below. In order to provide a sense of click at a final stage of operation, cam groove 153 is downwardly curved at its front end at a dull angle.

Figure 14:
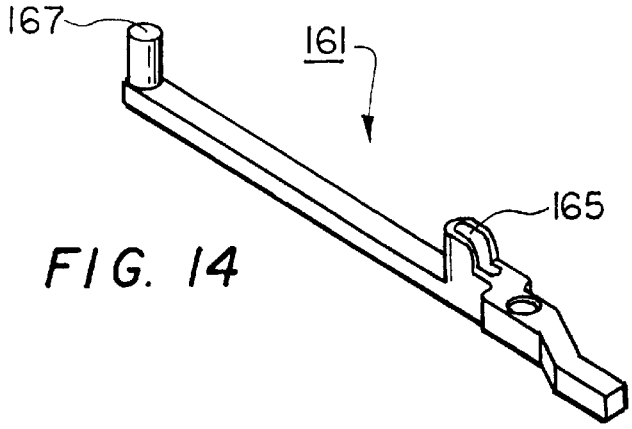
FIG. 14 is an enlarged perspective view of the right feed actuation member shown in FIG. 9.

Tool 101 further comprises a right feed actuation member 161 (also shown separately in FIG. 14). Actuation member 161, which may be made of molded plastic, is slidably retained in a slot 163 formed in right piece 103. As will hereinafter be described, member 161 is used to actuate the feeding of the runner bar 55-2 of a clip 11 into tool 101 at a pitch of one inserting member 41 per trigger stroke. Towards the front end of member 161, there is provided a projection 165, projection 165 being engageable with the front end of piston carrier 133. In this manner, towards the end of the forward movement of piston carrier 133, member 161 is engaged thereby and is moved forwardly a short distance. At the rear end of member 161 there is provided a post 167, post 167 being engageable with a rear-facing surface on top 133-1 of piston carrier 133. In this manner, towards the end of the return (i.e., rearward) movement of piston carrier 133, member 161 is engaged thereby and is moved to the rear of slot 163, where it is stopped by a stop 168 formed on right piece 103 of the housing. A spring 168-1 attached at one end to post 167 on actuation member 161 nd at the other end to a post 168-2 on housing piece 103 ensures that actuation member 161 will return sufficiently.

Figure 15:
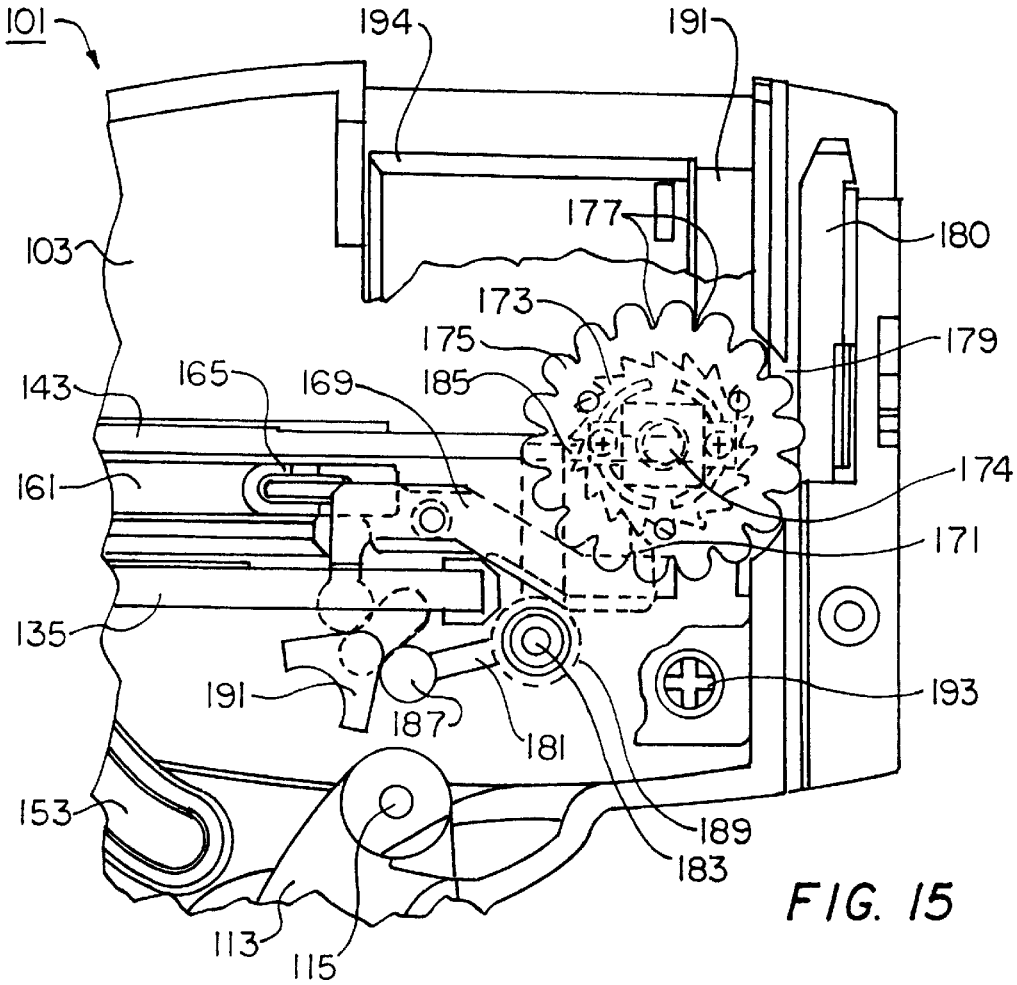
FIG. 15, is an enlarged, fragmentary, left side view, broken away in part, of the loop fastener dispensing tool of FIG. 5, with the housing cover and left portion of the tool not being shown for clarity.

As can be seen best in FIG. 15, a feed member 169, which may be made of molded plastic, is mounted on the front end of actuation member 161. The front end of feed member 169 is shaped to include a pawl 171. Pawl 171 is adapted to engage a ratchet 173 rotatably mounted on a post 174 formed on right piece 103. Ratchet 173, which may be made of molded plastic, is mechanically coupled to a feed gear 175. Feed gear 175, which may be made of metal, is shaped to define a plurality of notches 177, notches 177 being adapted to engage the severable connectors 59 of a clip 11 whose runner bar 55-2 has been inserted into a slot 179 formed in right piece 103. A stopper 181 for ratchet 173 is mounted on a post 183 formed on right piece 103, stopper 181 being free to turn about post 183 like a fulcrum. Stopper 181, which is bent in a generally dogleg-like configuration and which may be made of molded plastic, has an upper end 185 that is engageable with ratchet 173 and a lower end 187 that is actuated by and engageable with a releasing member 191 for permitting runner bar 55-2 to be removed from tool 101. A spring 189 is also mounted on post 183, one end of spring 189 biasing feed member 169 upwardly so that pawl 171 engages ratchet 173. Another end of spring 189 biases end 185 of stopper 181 to engage ratchet 173. In this manner, the above-described feeding mechanism feeds inserting elements 41 downwardly into slot 179 at a rate of one inserting element 41 per trigger stroke.

Figure 16:
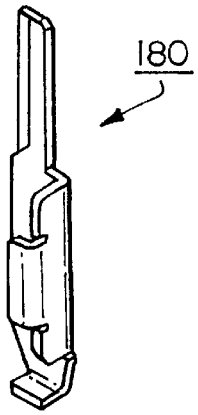
FIG. 16 is an enlarged perspective view of the cutting element shown in FIG. 8.

A cutting element 180 (also shown separately in FIG. 16) is mounted on right piece 103 and is used to sever the severable connector 59 connecting runner bar 55-2 to the particular inserting element 41 being dispensed as said inserting element 41 is pushed across cutting element 180 by piston 143. A plate 192, which may be made of metal, is mounted on right piece 103 with a screw 193, plate 192 covering much of the above-described feeding mechanism. A guide plate 194 which may be made of molded plastic, is mounted on top of plate 192, guide plate 194 serving to help keep piston 143 aligned with the inserting element 41 it is to engage.

Figure 17:
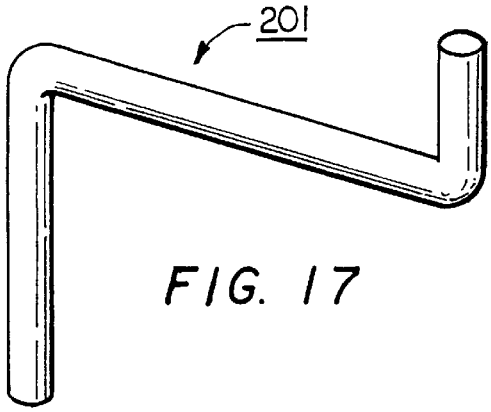
FIG. 17 is an enlarged perspective view of the linking pin shown in FIG. 8.
Figure 18A:
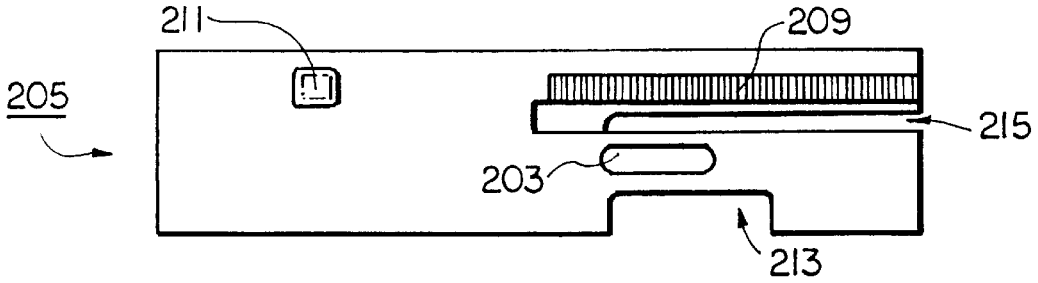
FIGS. 18(*a*) through 18(*d*) are enlarged (*a*) left side, (*b*) right side, (*c*) front, left, bottom perspective and (*d*) top views, respectively, of the rack shown in FIG. 10.
Figure 18B:
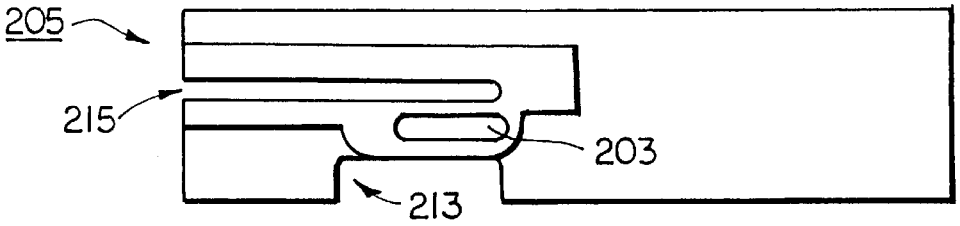
Figure 18C:
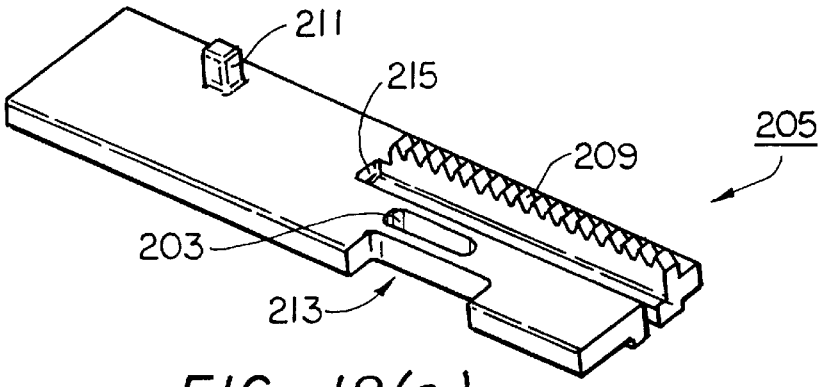
Figure 18D:
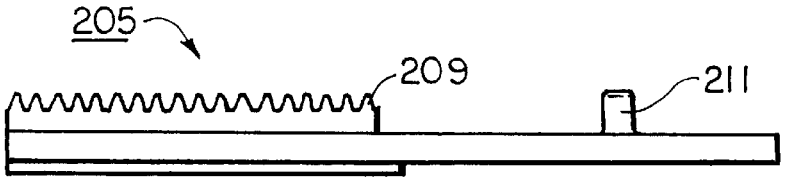

Referring back now to FIGS. 8 and 10, there can be seen, amongst other things, the various components located in the left portion of tool 101. As alluded to above, tool 101 includes a linking pin 201 (also shown separately in FIG. 17). One end of linking pin 201 is mounted in post 155 of cam 151. The other end of linking pin 201 travels in a slot 203 formed in a plate 205, plate 205 being slidably mounted in a slot 207 formed in lower left piece 105 of the housing. Slot 203 is considerably shorter than cam groove 153;

accordingly, once pin 201 is moved by cam 151 into engagement with the front or back edge of slot 203, continued movement of cam 151 in the same direction causes plate 205 to be correspondingly moved through slot 207.

Referring now to FIGS. 18(*a*) through 18(*d*), plate 205 is shown in greater detail. As can be seen, plate 205, which may be made of molded plastic, has integrally formed on its left side a rack 209. Rack 209 extends from the front end of plate 205 to about its midpoint. In addition, plate 205 is shaped to include a projection 211, which projects from the left side of plate 205 and which is disposed towards the rear end of plate 205 relative to rack 209. In addition, plate 205 is also provided with a pair of cutaway portions 213 and 215. Cutaway portions 213 and 215 enable plate 205 to be compressed slightly for tool tolerance purposes in those instances when plate 205 has been moved all the way forward through slot 207 prior to completion of the squeezing of trigger 113. This feature helps to minimize jamming of tool 101. The functions of rack 209 and projection 211 will be hereinafter described.

Referring back now to FIGS. 8 and 10, rack 209 is placed in engagement with a first gear 217, which may be made of molded plastic. Gear 217, which is rotatably mounted on a post 218 formed on lower left piece 105, is engaged by a second gear 219, gear 219 being rotatably mounted on a post 220 formed on lower left piece 105. As can be appreciated, gear 219 is mechanically coupled to rack 209 of plate 205 through gear 217.

Figure 19A:
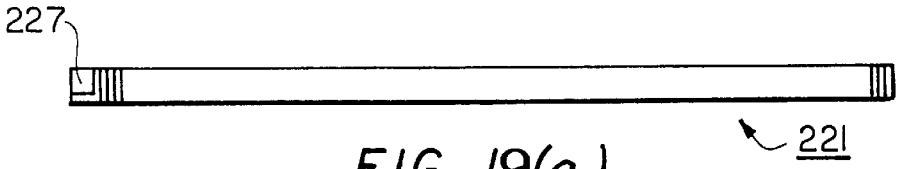
FIGS. 19(*a*) through 19(*c*) are enlarged (*a*) left side, (*b*) bottom and (*c*) top, rear, right perspective views, respectively, of the flexible belt member shown in FIG. 10.
Figure 19B:
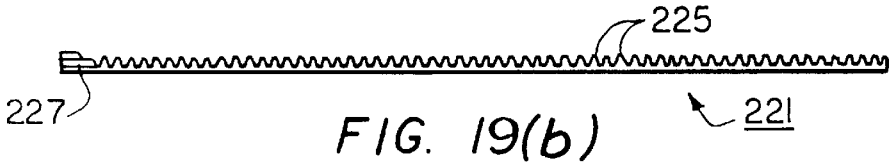
Figure 19C:
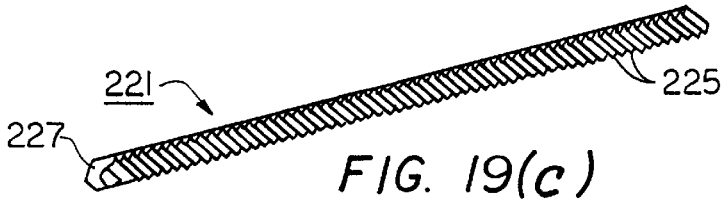

Tool 101 further comprises a flexible belt member 221 (also shown separately in FIGS. 19(*a*) through 19(*c*)). Belt member 221, which may be made of a molded plastic, is disposed in a slot 223 formed in lower left piece 105 and is used to push forwardly through slot 223 a socket 21 which has been fed into slot 223 in the manner to be described below. A plurality of teeth 225 are formed on the right side of belt member 221, teeth 225 being engaged by gear 219. Accordingly, belt 221 is mechanically coupled to plate 205 and moves back and forth through slot 223 as plate 205 moves back and forth, respectively, through slot 207. The front end 227 of belt member 221 is rectangular in shape and is sized so as to maximize the contact area with that portion of the front end 27-1 of a fastener socket 21 located below the filament 15.

Figure 20A:
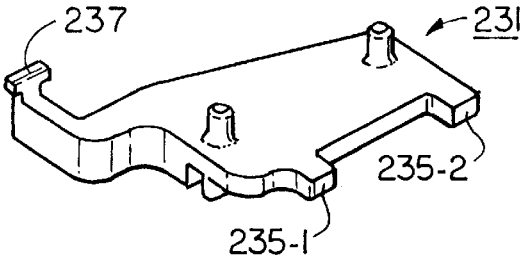
FIGS. 20(*a*) through 20(*c*) are enlarged (*a*) top, front, right perspective, (*b*) right, and (*c*) top views, respectively, of the left feed actuation member shown in FIG. 10.
Figure 20B:
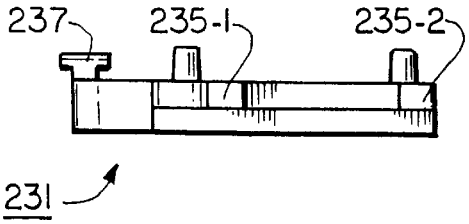
Figure 20C:
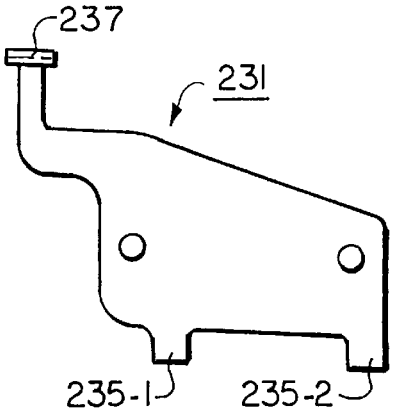

Tool 101 further includes a left feed actuation member 231 (also shown separately in FIGS. 20(*a*) through 20(*c*)). As will hereinafter be described, actuation member 231 is used to actuate the feeding of the runner bar 55-1 of a clip 11 into tool 101 at a pitch of one socket 21 per trigger stroke. Feed actuation member 231, which may be made of molded plastic, is slidably mounted in a slot 233 formed in lower left piece 105. A pair of spaced-apart tabs 235-1 and 235-2 are formed along the right side of feed actuation member 231, tabs 235-1 and 235-2 being engageable with projection 211, which travels therebetween. In this manner, towards the end of the forward movement of plate 205, tab 235-1 is engaged by projection 211 and member 231 is moved forwardly a short distance thereby. Towards the end of the return (i.e., rearward) movement of plate 205, tab 235-2 is engaged by projection 211 and member 231 is moved rearwardly to its original position. Feed actuation member 231 is also shaped to include a tab 237, whose function will be described below.

Figure 10:
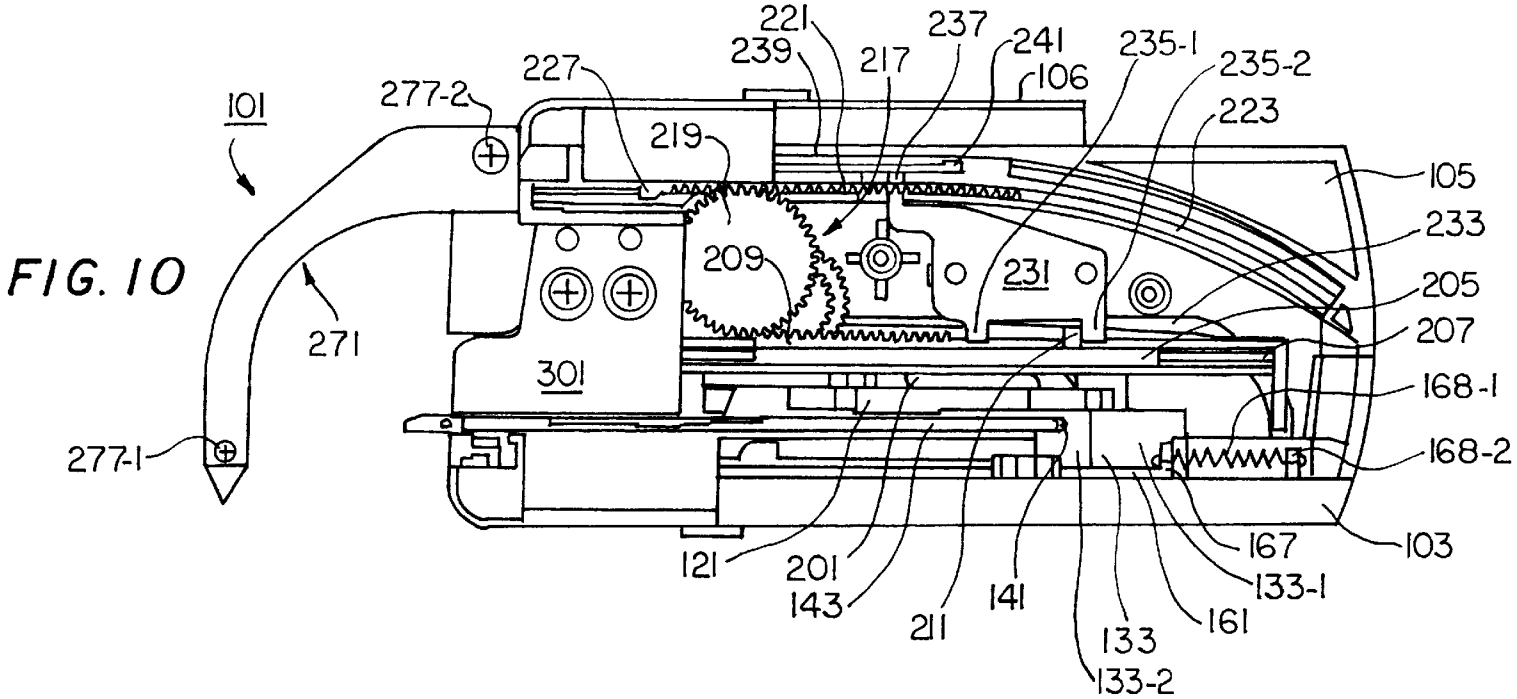
FIG. 10 is a top view of the loop fastener dispensing tool of FIG. 5, with the housing cover not being shown for clarity.
Figure 21:
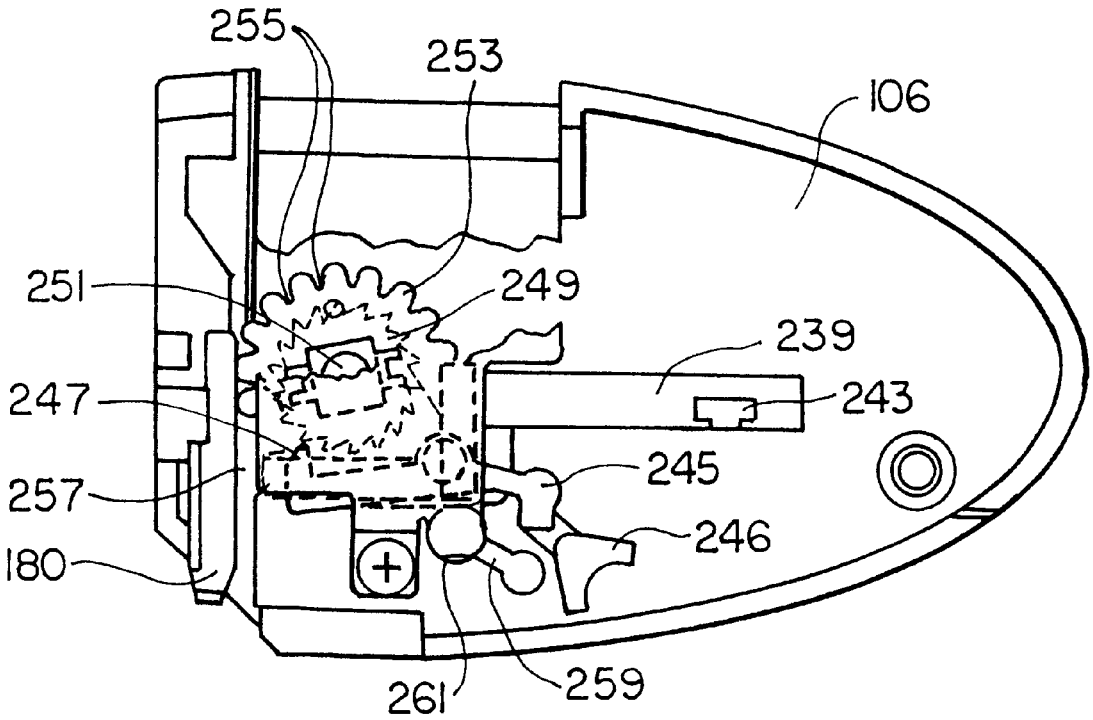
FIG. 21 is an enlarged right side view, broken away in part, of the fastener dispensing tool of FIG. 5, showing only those components housed within the upper left piece of the housing.
Figure 22:
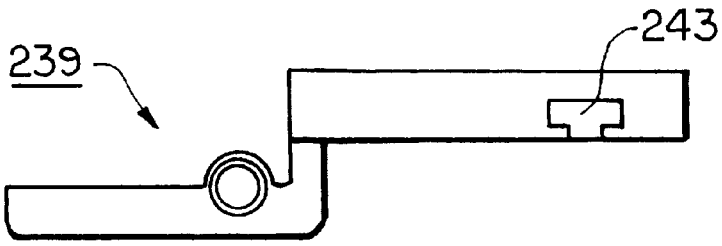
FIG. 22 is an enlarged right side view of the feed bar shown in FIG. 21.
Figure 23A:
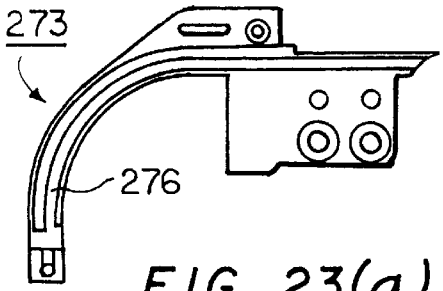
FIGS. 23(*a*) through 23(*d*) are (*a*) top, (*b*) top, front, right perspective, (*c*) bottom, front, left perspective and (*d*) front views, respectively, of the lower portion of the arm assembly shown in FIG. 8.

Referring now to FIGS. 8, 10 and 21, tool 101 further includes a feed coupling bar 239 (also shown separately in FIG. 22). Bar 239, which may be made of molded plastic, is slidably mounted in a slot 241 formed in lower left piece 105. Bar 239 is shaped to include a notch 243 located towards its rear end for receiving tab 237 of feed actuation member 231. In this manner, bar 239 is moved back and forth across slot 241 by member 231. A feed member 245, which may be made of molded plastic, is mounted on the front end of feed coupling bar 239. The front end of feed member 245 is shaped to include a pawl 247, and the rear end of member 245 is engageable with a releasing member 246 for permitting runner bar 55-1 to be removed from tool 101. Pawl 247 is adapted to engage a ratchet 249 rotatably mounted on a post 251 formed on upper left piece 106 of the tool housing. Ratchet 249, which may be made of molded plastic, is mechanically coupled to a feed gear 253. Feed gear 253, which may be made of metal, is shaped to include a plurality of notches 255, notches 255 being adapted to engage the severable connectors 57 of a clip 11 whose runner bar 55-1 has been inserted into a slot 257 formed in piece 106. A stopper 259 for ratchet 249, which stopper is similar in structure and function to stopper 181 for ratchet 173, is mounted on a post (not shown) formed on piece 106. A spring 261 is also mounted on said post, one end of spring 261 biasing feed member 245 upwardly so that pawl 247 engages ratchet 249, the other end of spring 261 biasing one end of stopper 259 to engage ratchet 249.

A cutting element 180 identical to that described previously for use in severing the severable connectors 59 connecting inserting elements 41 to runner bar 55-2 is mounted on upper left piece 106 and is used to sever the severable connector 57 connecting runner bar 55-1 to the particular socket 21 being dispensed as it is pushed through slot 223 across element 180 by belt 221. A plate 263, which may be made of metal, is mounted on upper left piece 106 with a screw 265, plate 263 covering much of the above-described feeding mechanism. A guide plate 266 is mounted on top of plate 263 to maintain belt member 221 in proper alignment. A guide 267, which may be made of molded plastic, is mounted on upper left piece 106 and is disposed between upper left piece 106 and plate 263, guide 267 serving to keep socket 41 positioned within slot 223 once it has been separated from clip 11 and as it is pushed forwardly along by belt 221.

Figure 24A:
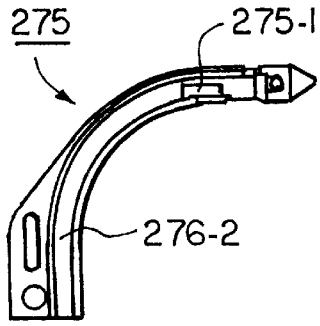
FIGS. 24(*a*) through 24(*c*) are (*a*) bottom, (*b*) bottom, front, left perspective and (*c*) front views, respectively, of the upper portion of the arm assembly shown in FIG. 8.
Figure 23B:
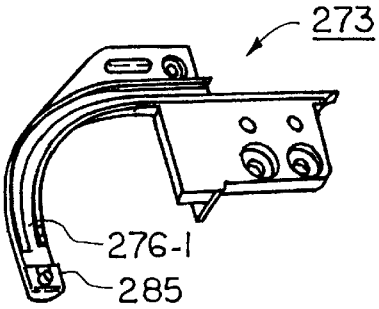
Figure 24B:
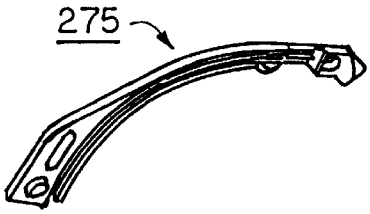
Figure 23C:
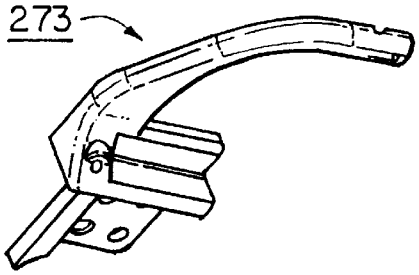
Figure 24C:
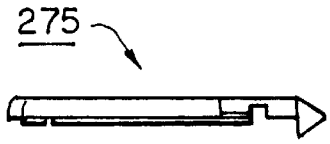
Figure 23D:
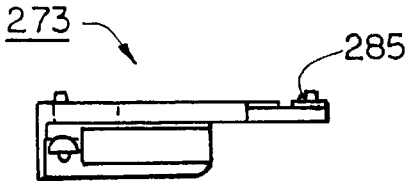
Figure 25:
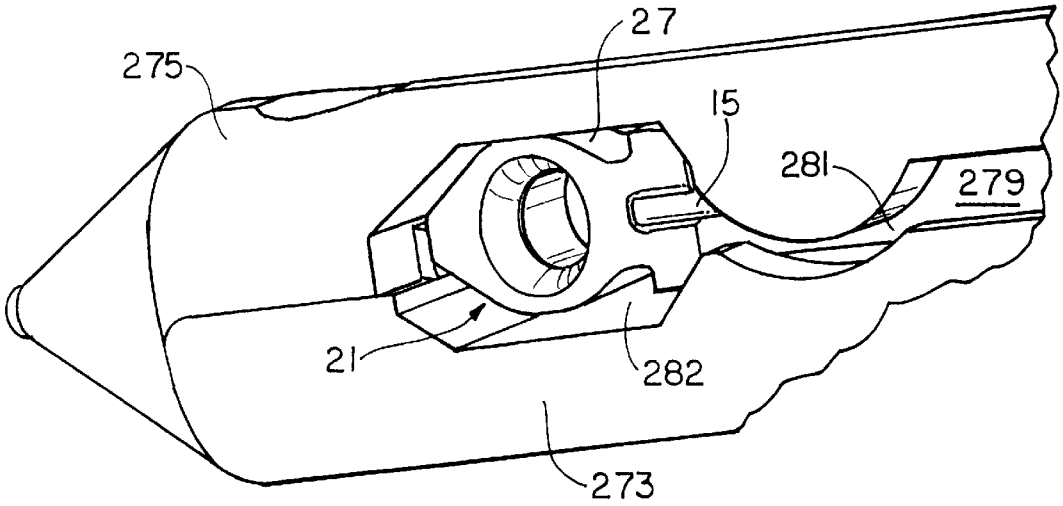
FIG. 25 is an enlarged, fragmentary top, rear, left perspective view of the arm assembly of FIG. 10, illustrating the complementary shape of the feed channel to a socket traveling therethrough.
Figure 26:
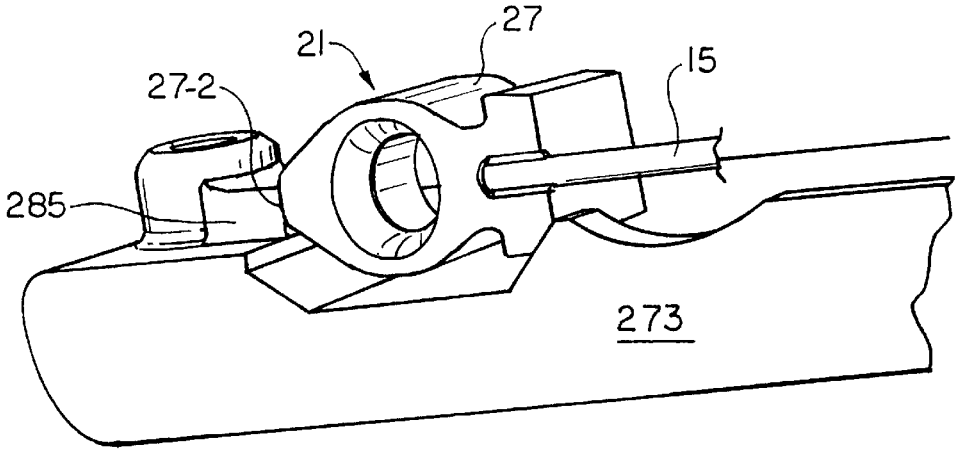
FIG. 26 is an enlarged, fragmentary, top, rear, left perspective view of the lower portion of the arm assembly of FIG. 10, with a fastener socket positioned against the stop formed in the lower portion of the arm assembly.

Referring now to FIGS. 8 and 10, tool 101 further comprises an arm assembly 271, arm assembly 271 comprising a lower portion 273 (also shown in FIGS. 23(*a*) through 23(*d*)) and an upper portion 275 (also shown in FIGS. 24(*a*) through 24(*c*)). Lower portion 273 is secured to lower left piece 105 by a plurality of screws 276, and upper portion 275 is secured to lower portion 273 by a plurality of screws 277-1 and 277-2. Lower portion 273 is shaped to include a groove 276-1, and upper portion 275 is shaped to include a complementary groove 276-2, grooves 276-1 and 276-2 jointly defining a feed channel 279 (see FIGS. 25 and 26), feed channel 279 being aligned with slot 223 in lower left piece 105 of the housing. As seen best in FIG. 24(*a*), upper portion 275 of arm assembly 271 includes a stop 275-1 to limit movement of belt 221 in arm assembly 271. As seen best in FIG. 25, feed channel 279 has a shape generally complementary to side wall 27 of socket 21 so as to minimize rotational movement of socket 21 about its longitudinal axis as socket 21 travels through feed channel 279. In this manner, the likelihood of fastener 13 becoming jammed in tool 101 is reduced. Lower portion 273 and upper portion 275 also jointly define a slot 281 that communicates with feed channel 279 and that permits the filament 15 associated with the socket 21 traveling through feed channel 279 to extend therethrough. As seen best in FIG. 26, lower portion 273 is also shaped to include a stop 285 positioned a short distance from the end of feed channel 279. Stop 285 is matingly shaped to engage the rear end 27-2 of socket 21 so that socket 21, at the end of its passage through feed channel 279, will be properly positioned translationally to receive its corresponding inserting element 41. The end of slot 281 proximate to stop 285 is enlarged to provide an opening 282 through which said inserting element 41 may be inserted in order to access said socket 21.

Tool 101 further comprises a needle plate 301 (also shown separately in FIGS. 27(*a*) through 27(*c*)). Plate 301, which may be made of metal, is secured to lower portion 273 of arm assembly 271 by screws 276 inserted through holes 302. Plate 301 is shaped to include a groove 303, which retains at least the front portion of and which guides piston 143. A blunt, hollow, slotted needle 305 is formed at the front of needle plate 301 in alignment with groove 303. A wedge-shaped detent 307, which tapers in the direction of the front end of needle 305, is formed on the top of the exterior surface of needle 305 to enable a tag T or an item of similar thickness to be seated securely on needle 305 while a fastener is dispensed through the hole H in the tag T. In this manner, an operator need not hold the tag on needle 305 during the dispensing of a fastener 13 from clip 11. (As can readily be appreciated, detent 307 can be included on needles used in a variety of different fastener dispensing tools and is not limited to the present application.)

To use tool 101 to dispense a fastener 13 from clip 11, one first inserts runner bars 55-1 and 55-2 into slots 257 and 179, respectively, until the lowermost socket 21 and lowermost inserting element 41 are aligned with belt 221 and piston 143, respectively. One then begins to squeeze trigger 113, first causing piston 143 to capture the lowermost inserting element 41 and to push it forward through needle 305, thereby severing its connector 59 from runner bar 55-2. At the same time, the front end 227 of belt 221 engages the front end 27-1 of socket 21 and pushes it through feed channel 279, thereby severing its connector 57 from runner bar 55-1. Continued squeezing of trigger 113 first causes socket 21 to be advanced all the way through channel 279 until the rear end 27-2 of socket 21 is engaged by stop 285 and then causes plug 43 of inserting element 41 to be inserted through upper portion 29-1 and past flange 31 of socket 21. Release of trigger 113 causes the retraction of piston 143 and belt 221 and causes the rotation of feed gear 175 and feed gear 253 so as to advance runner bars 55-2 and 55-1 by one fastener each.

A recess 107-6 formed on base portion 107-1 of cover 107 allows the filament of a fastener to extend down further into cover 107 to reduce the possibility so that a filament may get caught in the arm assembly when the head of a fastener is fed through.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A fastener clip comprising:

(a) a loop fastener comprising:

(i) a flexible filament having a first end and a second end;

(ii) a socket, said socket having a top surface, a bottom surface, and a front end, said first end of said flexible filament being disposed both on top of said top surface and against said front end, said socket being provided with a channel and a flange, said channel extending from said top surface to said bottom surface, said flange extending partially into said channel, said flexible filament extending away from said socket generally perpendicularly relative to said channel; and (iii) an inserting element disposed at said second end of said flexible filament, said inserting element including a plug insertable into said channel and past said flange, said plug being engageable with said flange after said plug has been inserted therepast so as to keep said plug from being easily withdrawn back past said flange;

(b) a first runner bar, said first runner bar being severably connected to said socket; and (c) a second runner bar, said second runner bar being severably connected to said inserting element.

2. The fastener clip as claimed in claim 1 wherein each of said flexible filament and said inserting element has a longitudinal axis and wherein the respective longitudinal axes of said flexible filament and said inserting element are coaxial.

3. The fastener clip as claimed in claim 1 wherein said flexible filament is straight prior to its being used.

4. The fastener clip as claimed in claim 1 wherein said flexible filament, said socket and said inserting part form a unitary structure made of molded plastic.

5. The fastener clip as claimed in claim 1 wherein said channel is generally circular in transverse cross-section and wherein said flange is a circumferential flange that extends partially into said channel, said flange being shaped to include an arcuate surface which extends convexly downwardly a short distance from said top surface and a slightly upwardly angled surface which extends outwardly a short distance from the bottom of said arcuate surface, said flange dividing said channel into a lower portion and an upper portion, said upper portion and said lower portion being interconnected by an aperture defined by said flange.

6. The fastener clip as claimed in claim 5 wherein said plug comprises a head and a pair of outwardly biasing spring tabs, each of said outwardly biasing spring tabs being attached at one end thereof to said head.

7. The fastener clip as claimed in claim 5 wherein said socket is generally octagonal in transverse cross-sectional shape.

8. The fastener clip as claimed in claim 1 wherein said plug comprises a head and a pair of outwardly biasing spring tabs, each of said outwardly biasing spring tabs being attached at one end thereof to said head.

9. The fastener clip as claimed in claim 1 wherein said inserting part further comprises a stop for limiting forward movement of said plug past said flange.

10. The fastener clip as claimed in claim 1 wherein said inserting part further comprises a stop for limiting forward movement of said plug past said flange, said stop being appropriately spaced from said plug to prevent tampering with said spring tabs once said plug has been inserted past said flange.

11. The fastener clip as claimed in claim 1 wherein said socket is generally octagonal in transverse cross-sectional shape.

12. The fastener clip as claimed in claim 1 wherein both of the longitudinal axes of said first runner bar and said second runner bar are not disposed in the same plane as the longitudinal axis of said loop fastener, wherein said first runner bar is spaced inwardly relative to the end of said socket and wherein said second runner bar is spaced inwardly relative to the end of said inserting element.

13. A fastener clip comprising:

(a) a loop fastener comprising:

(i) a flexible filament having a first end and a second end;

(ii) a socket, said socket being disposed at said first end of said flexible filament, said socket being provided with a channel and a flange, said flange extending partially into said channel, said socket being generally octagonal in cross-sectional shape;

(iii) an inserting element disposed at said second end of said flexible filament, said inserting element including a plug insertable into said channel and past said flange, said plug being engageable with said flange after said plug has been inserted therepast so as to keep said plug from being easily withdrawn from said channel back past said flange;

(b) a first runner bar, said first runner bar being severably connected to said socket; and (c) a second runner bar, said second runner bar being severably connected to said inserting element.

14. The fastener clip as claimed in claim 13 wherein both of the longitudinal axes of said first runner bar and said second runner bar are not disposed in the same plane as the longitudinal axis of said loop fastener, wherein said first runner bar is spaced inwardly relative to the end of said socket and wherein said second runner bar is spaced inwardly relative to the end of said inserting element.

15. A fastener clip comprising:

(a) a loop fastener comprising:

(i) a flexible filament having a first end and a second end;

(ii) a socket, said socket being disposed at said first end of said flexible filament, said socket having a top surface, a bottom surface, a channel, said channel extending from said top surface to said bottom surface and being generally circular in transverse cross-section, and a circumferential flange, said circumferential flange extending partially into said channel and being shaped to include an arcuate surface extending convexly downwardly from said top surface; and (iii) an inserting element disposed at said second end of said flexible filament, said inserting element including a plug insertable into said channel and engageable with said circumferential flange so as to keep said plug from being easily withdrawn from said channel back past said circumferential flange;

(b) a first runner bar, said first runner bar being severably connected to said socket; and (c) a second runner bar, said second runner bar being severably connected to said inserting element.

16. The fastener clip as claimed in claim 15 wherein said socket has a front end and wherein said first end of said flexible filament is disposed both on top of said top surface and against said front end of said socket.

17. The fastener clip as claimed in claim 16 wherein said socket is generally octagonal in transverse cross-section.

18. The fastener clip as claimed in claim 15 wherein said socket is generally octagonal in transverse cross-section.

19. The fastener clip as claimed in claim 15 wherein said circumferential flange further comprises a slightly upwardly angled surface which extends outwardly a short distance from the bottom of said arcuate surface.

20. The fastener clip as claimed in claim 15 wherein at least one of the longitudinal axes of said first runner bar and said second runner bar is not disposed in the same plane as the longitudinal axis of said loop fastener.

21. A fastener clip comprising:

(a) a loop fastener comprising:

(i) a flexible filament having a first end and a second end;

(ii) a socket, said socket being generally octagonal in transverse cross-sectional shape and having a top surface, a bottom surface, and a front end, said first end of said flexible filament being disposed both on top of said top surface and against said front end, said socket being provided with a channel and a flange, said channel extending from said top surface to said bottom surface and being generally circular in transverse cross-section, said flange extending partially into said channel and being a circumferential flange that extends partially into said channel, said flange being shaped to include an arcuate surface which extends convexly downwardly a short distance from said top surface and a slightly upwardly angled surface which extends outwardly a short distance from the bottom of said arcuate surface, said flange dividing said channel into a lower portion and an upper portion, said upper portion and said lower portion being interconnected by an aperture defined by said flange, said flexible filament extending away from said socket generally perpendicularly relative to said channel; and (iii) an inserting element disposed at said second end of said flexible filament, said inserting element including a plug insertable into said channel and past said flange, said plug being engageable with said flange after said plug has been inserted therepast so as to keep said plug from being easily withdrawn back past said flange;

(b) a first runner bar, said first runner bar being severably connected to said socket; and (c) a second runner bar, said second runner bar being severably connected to said inserting element.

22. The fastener clip as claimed in claim 21 wherein both of the longitudinal axes of said first runner bar and said second runner bar are not disposed in the same plane as the longitudinal axis of said loop fastener, wherein said first runner bar is spaced inwardly relative to the end of said socket and wherein said second runner bar is spaced inwardly relative to the end of said inserting element.

23. The fastener clip as claimed in claim 21 wherein both of the longitudinal axes of said first runner bar and said second runner bar are not disposed in the same plane as the longitudinal axis of said loop fastener.

* * * * *